US008345033B2

(12) United States Patent
Pankaj et al.

(10) Patent No.: US 8,345,033 B2
(45) Date of Patent: Jan. 1, 2013

(54) IMAGE PROCESSING APPARATUS AND CONTROL METHOD THEREOF FOR CONTROLLING THE INCREASE IN VOLTAGE

(75) Inventors: Agarwal Pankaj, Suwon-si (KR); Jin-gil Jeong, Seoul (KR); Joon-hyun Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 546 days.

(21) Appl. No.: 12/544,781

(22) Filed: Aug. 20, 2009

(65) Prior Publication Data

US 2010/0156872 A1 Jun. 24, 2010

(30) Foreign Application Priority Data

Dec. 23, 2008 (KR) ..... 10-2008-0132193

(51) Int. Cl.
*G09G 5/00* (2006.01)

(52) U.S. Cl. ..... 345/211

(58) Field of Classification Search ..... 345/211–213; 315/169.1–169.4; 362/97.2–97.4
See application file for complete search history.

(56) References Cited

U.S. PATENT DOCUMENTS

| | | | | |
|---|---|---|---|---|
| 5,283,476 | A * | 2/1994 | Wakabayashi | 327/125 |
| 5,854,615 | A * | 12/1998 | Hush | 345/99 |
| 2007/0252827 | A1* | 11/2007 | Hirota | 345/204 |
| 2008/0007183 | A1* | 1/2008 | Tatsumi | 315/160 |
| 2008/0278098 | A1* | 11/2008 | Kamatani | 315/294 |

* cited by examiner

*Primary Examiner* — Chanh Nguyen
*Assistant Examiner* — Ram Mistry
(74) *Attorney, Agent, or Firm* — Sughrue Mion, PLLC

(57) ABSTRACT

An image processing apparatus, a power supply apparatus and a circuit apparatus, the image processing apparatus including a display unit which displays thereon an input image, and a power supply unit which outputs direct current power to drive the display unit, but gradually increases a voltage level of the direct current power.

20 Claims, 3 Drawing Sheets

IMAGE PROCESSING APPARATUS AND CONTROL METHOD THEREOF FOR CONTROLLING THE INCREASE IN VOLTAGE

CROSS-REFERENCE TO RELATED APPLICATION

This application claims priority from Korean Patent Application No. 10-2008-0132193, filed on Dec. 23, 2008, in the Korean Intellectual Property Office, the disclosure of which is incorporated herein by reference in its entirety.

BACKGROUND OF THE INVENTION

1. Field of the Invention

Apparatuses and methods consistent with the present invention relate to an image processing apparatus and a control method thereof, and more particularly, to an image processing apparatus and a control method thereof which gradually increases a voltage level of direct current (DC) power supplied to a display unit to supply power stably.

2. Description of the Related Art

An image processing apparatus, e.g., a digital TV (DTV) processes an input image and displays the image on a display panel such as a liquid crystal display (LCD). The image processing apparatus includes a high voltage power supply (HVPS) which converts commercial alternating current (AC) power into high-voltage DC power to be supplied to each element for operation.

If power is applied to the image processing apparatus, the HVPS receives commercial AC power and converts the commercial AC power into DC power at high voltages of 10 to 15 kV. However, as the voltage level of the power increases drastically, not only the HVPS itself, but also each element of the image processing apparatus, inter alia, a display unit which receives the power, is stressed and life of the display unit is reduced.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

According to an aspect of the present invention, there is provided an image processing apparatus including: a display unit which displays thereon an input image; and a power supply unit which outputs direct current power to drive the display unit, but gradually increases a voltage level of the direct current power.

The power supply unit may gradually increase the voltage level of the direct current power to apply initial power to the display unit.

The power supply unit may include a delay unit which gradually delays an increase in the voltage level of the direct current power for at least one time period.

The delay unit may include a comparator which senses the voltage level of the direct current power and compares the voltage level of the direct current power with a predetermined reference voltage, and gradually delays an increase in the voltage level of the direct current power for at least one time period based on an output signal of the comparator.

The delay unit may include at least one delay circuit which gradually delays an increase in the voltage level of the direct current power for at least one time period based on an output signal of the comparator while the at least one delay circuit is connected with each other in parallel.

The delay circuit may include a feedback resistor, whose first end is coupled to or connected with a terminal in relation to the direct current power.

The terminal in relation to the direct current power may include a terminal in which voltages of the direct current power are divided by predetermined resistors.

The delay circuit may include a capacitor which starts being charged on the basis of the output signal of the comparator and delays an increase in the voltage level of the direct current power for a predetermined time.

The delay circuit may include a transistor which is switched on and off to couple or connect the feedback resistor and a base voltage level GND based on a charging level of the capacitor.

According to another aspect of the present invention, there is provided a power supply apparatus including: a power converter which converts alternating current power into direct current power and outputs the direct current power; a voltage controller which controls an output voltage level of the direct current power; and a feedback unit which senses the direct current power and outputs a feedback voltage to the voltage controller to gradually increase the voltage level of the direct current power.

The feedback unit may output a feedback voltage to the voltage controller to gradually increase the voltage level of the direct current power when initial power is applied.

The power supply apparatus may include a delay unit which gradually delays an increase in the voltage level of the direct current power for at least one time period.

The delay unit may include a comparator which senses the voltage level of the direct current power and compares the voltage level of the direct current power with a predetermined reference voltage and gradually delays an increase in the voltage level of the direct current power for at least one time period based on the output signal of the comparator.

The delay unit may include at least one delay circuit which gradually delays an increase in the voltage level of the direct current power for at least one time period based on an output signal of the comparator while the at least one delay circuit is coupled or connected with each other in parallel.

The delay circuit may include a feedback resistor, whose first end is coupled to or connected with a terminal in relation to the direct current power.

The terminal in relation to the direct current power may include a terminal in which voltages of the direct current power are divided by predetermined resistors.

The delay circuit may include a capacitor which starts being charged on the basis of the output signal of the comparator and delays an increase in the voltage level of the direct current power for a predetermined time.

The delay circuit may include a transistor which is switched on and off to connect the feedback resistor and a base voltage level GND based on a charging level of the capacitor.

According to another aspect of the present invention, there is provided a circuit apparatus which controls a voltage level of direct current power which is converted from alternating current power, the circuit apparatus further including a delay unit which gradually delays an increase in the voltage level of the direct current power for at least one time period.

The delay unit may include a comparator which senses the voltage level of the direct current power and compares the voltage level of the direct current power with a predetermined reference voltage, and gradually delays the increase in the voltage level of the direct current power for at least one time period based on the output signal of the comparator.

The delay unit may include at least one delay circuit which gradually delays an increase in the voltage level of the direct current power for at least one time period based on an output signal of the comparator while the at least one delay circuit is coupled or connected with each other in parallel.

The delay circuit may include a feedback resistor, whose first end is coupled to or connected with a terminal in relation to the direct current power.

The terminal in relation to the direct current power may include a terminal in which voltages of the direct current power are divided by predetermined resistors.

The delay circuit may include a capacitor which starts being charged on the basis of the output signal of the comparator and delays an increase in the voltage level of the direct current power for a predetermined time.

The delay circuit may include a transistor which is switched on and off to couple or connect the feedback resistor and a base voltage level GND based on a charging level of the capacitor.

BRIEF DESCRIPTION OF THE DRAWINGS

The above and/or other aspects of the present invention will become apparent and more readily appreciated from the following description of exemplary embodiments, taken in conjunction with the accompanying drawings of which.

DETAILED DESCRIPTION OF EXEMPLARY EMBODIMENT

Hereinafter, exemplary embodiments of the present invention will be described with reference to accompanying drawings, wherein like numerals refer to like elements and repetitive descriptions will be avoided when possible.

Figure 1:
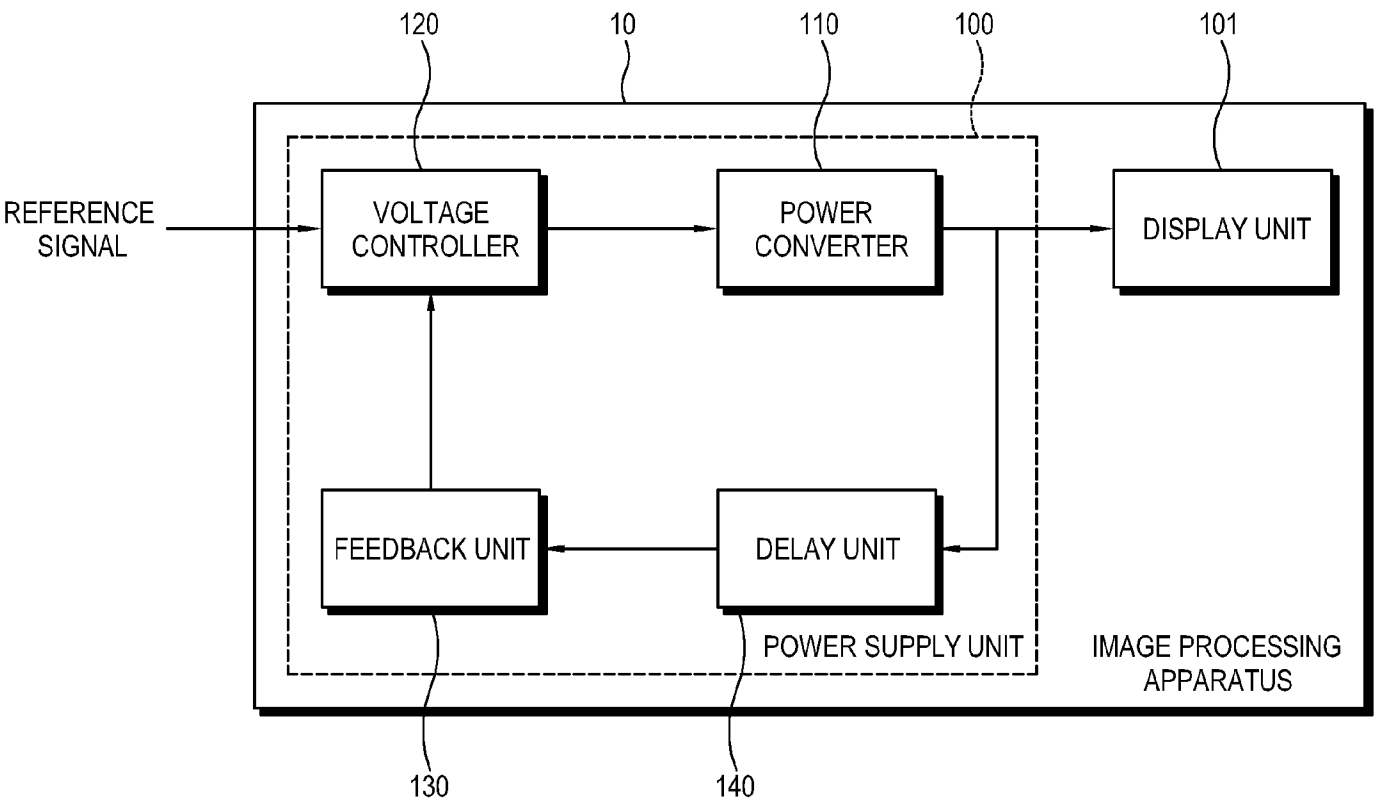
FIG. 1 is a control block diagram of an image processing apparatus according to an exemplary embodiment of the present invention.

FIG. 1 is a control block diagram of an image processing apparatus according to an exemplary embodiment of the present invention.

As shown therein, an image processing apparatus 10 according to an exemplary embodiment processes an input image and displays the processed image on a display panel such as a liquid crystal panel (LCD). The image processing apparatus 10 may include a digital TV. According to an exemplary embodiment of the present invention, upon an initial supply of power, the image processing apparatus 10 gradually increases a voltage level of DC power supplied to a display unit 101 to stably supply power.

As shown therein, the image processing apparatus 10 according to an exemplary embodiment of the present invention includes the display unit 101 to process an input image and display the processed image thereon, and a power supply unit 100 to gradually increase a voltage level of DC power before outputting the DC power to drive the display unit 101.

The display unit 101 displays thereon an input image. The display unit 101 may include a display panel (not shown) to display an image thereon, a panel driver (not shown) to control a driving of the display panel and a backlight assembly (not shown) to emit light to the display panel. The display panel according to exemplary embodiments of the present invention may include various types of display modules such as a digital light processing (DLP), a liquid crystal display (LCD) and a plasma display panel (PDP).

The power supply unit 100 converts commercial AC power into high-voltage DC power to supply the DC power to the display unit 101. Typically, the power supply unit 100 may include an HVPS. As shown in FIG. 1, the power supply unit 100 may include a power converter 110, a voltage controller 120, a feedback unit 130 and a delay unit 140.

Hereinafter, the power supply unit 100 according to an exemplary embodiment of the present invention will be described in more detail with reference to FIGS. 2 and 3.

Figure 2:
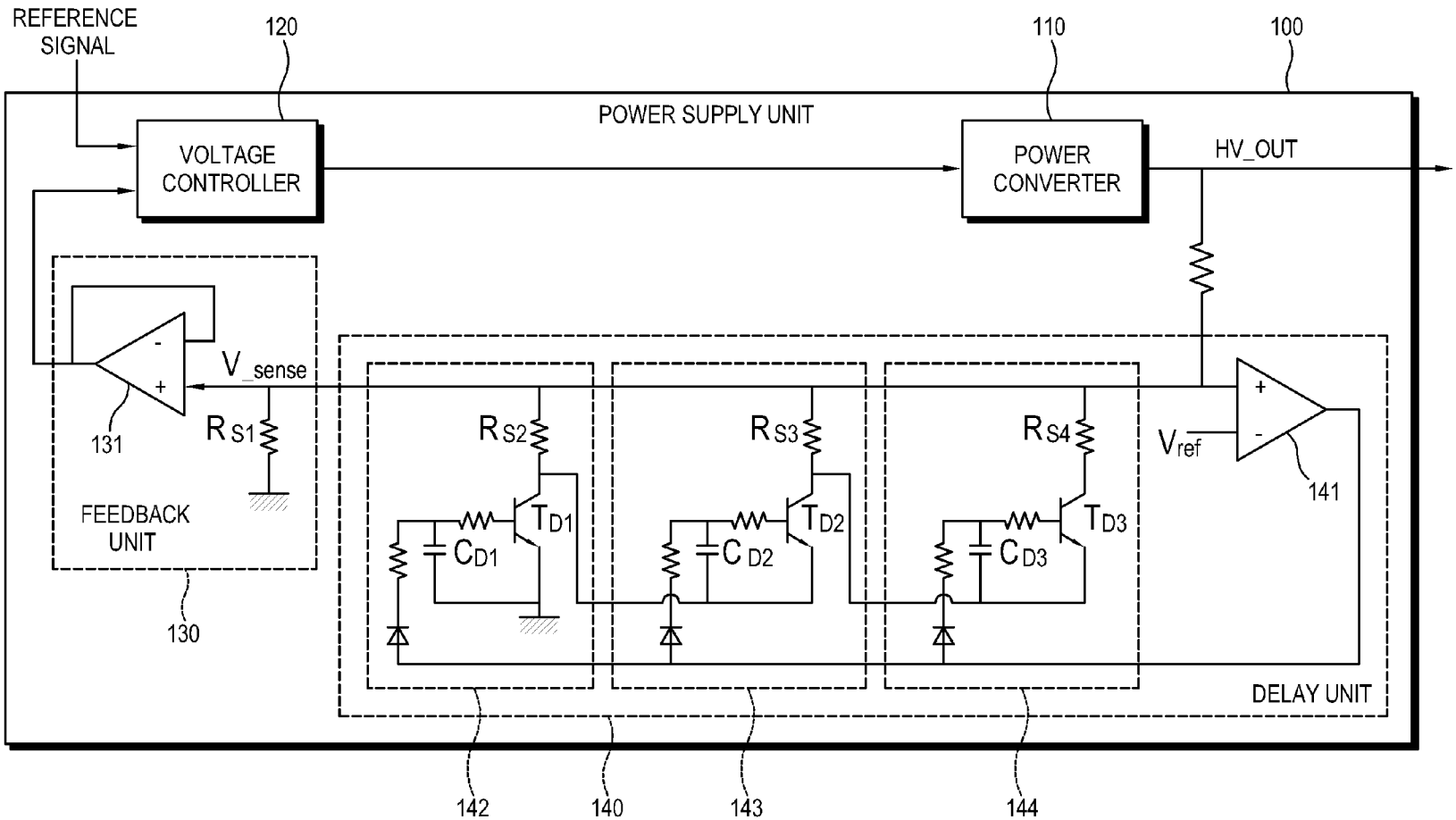
FIG. 2 illustrates an example of a circuit configuration of a power supply unit according to an exemplary embodiment of the present invention.

FIG. 2 illustrates an example of a circuit configuration of the power supply unit 100 according to an exemplary embodiment of the present invention.

The power converter 110 converts input commercial AC power into high-voltage DC power (HV_OUT). The power converter 110 may include a transformer (not shown) to transform an AC signal in a predetermined frequency into a high-voltage signal, and a voltage divider (not shown) to rectify and divide voltages of the high-voltage signal. The power converter 110 may include various other configurations, which are known to those skilled in the art. Thus, detailed description of such various configurations will be avoided.

The voltage controller 120 amplifies a reference signal and a feedback signal output from the feedback unit 130, and adjusts a voltage level of output power output from the power converter 110. That is, the voltage controller 120 controls the power converter 110 to output DC power based on an output signal of a first comparator 131. For example, the voltage controller 120 may control the voltage converter 110 to output DC power HV-OUT in proportion to an output voltage of the first comparator 131.

The feedback unit 130 senses high-voltage DC power output from the power converter 110 and supplies a feedback signal to the voltage controller 120. As shown in FIG. 2, the feedback unit 130 includes the first comparator 131 and a first feedback resistor RS1.

The delay unit 140 delays an increase of the voltage level of the DC power output by the power converter 110 for a predetermined time. As shown in FIG. 2, the delay unit 140 includes a second comparator 141, and at least one delay circuit (for example, at least one of delay circuits 142, 143 and 144).

According to an exemplary embodiment of the present invention, the first delay circuit 142 includes a second feedback resistor RS2, a first capacitor CD1 and a first transistor TD1. The second delay circuit 143 includes a third feedback resistor RS3, a second capacitor CD2 and a second transistor TD2. The third delay circuit 144 includes a fourth feedback resistor RS4, a third capacitor CD3 and a third transistor TD3.

With the foregoing configuration, a process of outputting gradually-increasing output power HV-OUT by the power supply unit 100 according to an exemplary embodiment of the present invention will be described.

Figure 3:
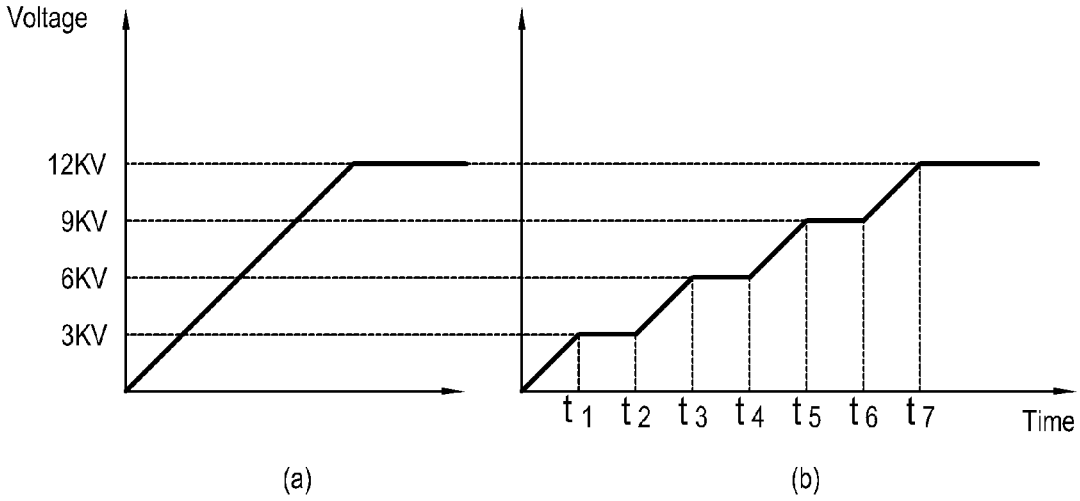
FIG. 3 is a graph which illustrates changes in voltage levels of output power depending on time, output by the power supply unit according to an exemplary embodiment of the present invention.

FIG. 3 is a graph which illustrates changes in voltage levels of the output power HV_OUT depending on time, output by the power supply unit 100 according to an exemplary embodiment of the present invention. In FIG. 3, an axis X refers to a time axis and an axis Y refers to output power, i.e., a voltage level of the DC power HV-OUT.

Referring to (a) in FIG. 3, it will be assumed for the purpose of this example that the value of the first feedback resistor RS1 is RΩ and a final voltage level of the output power HV_OUT is 12 kV. That is, the delay unit 140 is omitted and only the first feedback resistor RS1 is connected to the configuration of the power supply unit 100 shown in FIG. 2. As shown in (a) in FIG. 3, when power is applied, the voltage level of the output power HV_OUT linearly increases and reaches the final voltage level.

Referring to (b) in FIG. 3, it will be assumed for the purpose of this example that the value of the first feedback resistor RS1 to the fourth feedback resistor RS4 is each 4 RΩ, and the final voltage level of the output power HV_OUT is 12 kV. For purposes of convenience, it will be assumed that the power supply unit 100 includes four feedback resistors from the first feedback resistor RS1 to the fourth feedback resistor RS4, and three delay circuits from the first delay circuit 142 to the third delay circuit 144.

If power is applied to the power supply apparatus 100 according to an exemplary embodiment, the first transistor TD1 to the third transistor TD3 of the delay unit 140 are turned off and thus only the first feedback resistor RS1 of 4 RΩ is connected to the circuit and the voltage level of the output power HV_OUT rises to 3 kV as shown in (b) in FIG. 3 (period t0 to t1).

If the voltage level of the output power HV_OUT reaches 3 kV, the second comparator 141 outputs a signal and the first capacitor CD1 of the first delay circuit 142 starts being charged. While the first capacitor CD1 is charged, the voltage level of the output power HV_OUT maintains 3 kV (period t1 to t2). If the first capacitor CD1 is charged up to a predetermined level, the first transistor TD1 of the first delay circuit 142 is turned on and the second feedback resistor RS2 is connected to the circuit. Then, the first feedback resistor RS1 and the second feedback resistor RS2 are coupled or connected in parallel to the circuit. The value of the feedback resistors is 2 RΩ in total, and the voltage level of the output power HV_OUT rises to 6 kV again as shown in (b) in FIG. 3 (period t2 to t3).

If the voltage level of the output power HV_OUT reaches 6 kV, the second comparator 141 outputs a signal, and the second capacitor CD2 of the second delay circuit 143 starts being charged. While the second capacitor CD2 is charged, the voltage level of the output power HV_OUT maintains 6 kV (period t3 to t4). If the second capacitor CD2 is charged up to a predetermined level, the second transistor TD2 of the second delay circuit 143 is turned on and the third feedback resistor RS3 is connected to the circuit. Accordingly, the first feedback resistor RS1, the second feedback resistor RS2 and the third feedback resistor RS3 are coupled or connected in parallel to the circuit. The value of the feedback resistors is 4 R/3Ω in total and the voltage level of the output power HV_OUT rises to 9 kV as shown in (b) in FIG. 3 (period t4 to t5).

If the voltage level of the output power HV_OUT reaches 9 kV, the second comparator 141 outputs a signal, and the third capacitor CD3 of the third delay circuit 144 starts being charged. While the third capacitor CD3 is charged, the voltage level of the output power HV_OUT maintains 9 kV (period t5 to t6). If the third capacitor CD3 is charged up to a predetermined level, the third transistor TD3 of the third delay circuit 144 is turned on and the fourth feedback resistor RS4 is connected to the circuit. Accordingly, the first feedback resistor RS1, the second feedback resistor RS2, the third feedback resistor RS3 and the fourth feedback resistor RS4 are coupled or connected in parallel to the circuit. The value of the feedback resistors is RΩ in total and the voltage level of the output power HV_OUT rises to 12 kV as shown in (b) in FIG. 3 (period t6 to t7).

As described above, the power supply unit 100 according to an exemplary embodiment of the present invention includes at least one of the delay circuits 142, 143 and 144 to suspend an increase in DC power for a predetermined time to thereby gradually increase the voltage level of the DC power and supply stable power to the display unit 101.

According to an exemplary embodiment, the power supply unit 100 includes four feedback resistors RS1, RS2, RS3 and RS4 and three delay circuits 142, 143 and 144, but is not limited thereto. Alternatively, the number of the feedback resisters and delay circuits may vary depending on the voltage level to be adjusted. Further, the predetermined time for which the increase in the voltage level of the output power is suspended may vary depending on the capacity of the capacitor.

Although exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. An image processing apparatus comprising:

a display unit which displays thereon an input image; and a power supply unit which outputs direct current power to drive the display unit, and gradually increases a voltage level of the direct current power, wherein the power supply unit gradually increases the voltage level of the direct current power to apply initial power to the display unit, wherein the power supply unit comprises a delay unit which gradually delays the increase in the voltage level of the direct current power for at least one time period, wherein the delay unit comprises a comparator which senses the voltage level of the direct current power and compares the voltage level of the direct current power with a reference voltage, and gradually delays the increase in the voltage level of the direct current power for at least one time period based on an output signal of the comparator, and wherein the delay unit comprises a plurality of delay circuits which gradually delay the increase in the voltage level of the direct current power for at least one time period based on the output signal of the comparator, and wherein each delay circuit of the plurality of delay circuits are coupled to each other in parallel.

2. The image processing apparatus according to claim 1, wherein the power supply unit gradually increases the voltage level of the direct current power to apply initial power to the display unit.

3. The image processing apparatus according to claim 1, wherein the delay unit comprises a comparator which senses the voltage level of the direct current power and compares the voltage level of the direct current power with a reference voltage, and gradually delays the increase in the voltage level of the direct current power for at least one time period based on an output signal of the comparator.

4. The image processing apparatus according to claim 1, wherein each delay circuit of the plurality of delay circuits comprises a feedback resistor having a first end which is coupled to a terminal in relation to the direct current power.

5. The image processing apparatus according to claim 4, wherein the terminal in relation to the direct current power comprises a terminal in which voltages of the direct current power are divided by a plurality of resistors.

6. The image processing apparatus according to claim 1, wherein each delay circuit of the plurality of delay circuits comprises a capacitor which starts being charged on the basis of the output signal of the comparator and delays the increase in the voltage level of the direct current power for a respective period of time.

7. The image processing apparatus according to claim 6, wherein each delay circuit of the plurality of delay circuits comprises a transistor which is switched on and off to couple the feedback resistor with a base voltage level GND based on a charging level of the respective capacitor.

8. A power supply apparatus comprising:

a power converter which converts alternating current power into direct current power and outputs the direct current power;

a voltage controller which controls an output voltage level of the direct current power; and a feedback unit which senses the direct current power and outputs a feedback voltage to the voltage controller so as to gradually increase the output voltage level of the direct current power wherein the feedback unit outputs the feedback voltage to the voltage controller so as to gradually increase the output voltage level of the direct current power when power is initially applied;

further comprising a delay unit which gradually delays the increase in the output voltage level of the direct current power for at least one time period wherein the delay unit comprises a comparator which senses the output voltage level of the direct current power and compares the output voltage level of the direct current power with a reference voltage and gradually delays the increase in the output voltage level of the direct current power for at least one time period based on an output signal of the comparator, and wherein the delay unit comprises a plurality of delay circuits which gradually delay the increase in the output voltage level of the direct current power for at least one time period based on the output signal of the comparator, and wherein each delay circuit of the plurality of delay circuits are coupled to each other in parallel.

9. The power supply apparatus according to claim 8, wherein the feedback unit outputs the feedback voltage to the voltage controller so as to gradually increase the output voltage level of the direct current power when power is initially applied.

10. The power supply apparatus according to claim 8, wherein the delay unit comprises a comparator which senses the output voltage level of the direct current power and compares the output voltage level of the direct current power with a reference voltage and gradually delays the increase in the output voltage level of the direct current power for at least one time period based on an output signal of the comparator.

11. The power supply apparatus according to claim 8, wherein each delay circuit of the plurality of delay circuits comprises a feedback resistor having a first end which is coupled to a terminal in relation to the direct current power.

12. The power supply apparatus according to claim 11, wherein the terminal in relation to the direct current power comprises a terminal in which voltages of the direct current power are divided by a plurality of resistors.

13. The power supply apparatus according to claim 8, wherein each delay circuit of the plurality of delay circuits comprises a capacitor which starts being charged on the basis of the output signal of the comparator and delays the increase in the output voltage level of the direct current power for a respective period of time.

14. The power supply apparatus according to claim 13, wherein each delay circuit of the plurality of delay circuits comprises a transistor which is switched on and off to couple a respective feedback resistor with a base voltage level GND based on a charging level of the respective capacitor.

15. A circuit apparatus which controls a voltage level of direct current power which is converted from alternating current power, the circuit apparatus comprising a delay unit which gradually delays an increase in the voltage level of the direct current power for at least one time period wherein the delay unit comprises a comparator which senses the voltage level of the direct current power and compares the voltage level of the direct current power with a reference voltage, and gradually delays the increase in the voltage level of the direct current power for at least one time period based on an output signal of the comparator, and wherein the delay unit comprises a plurality of delay circuits which gradually delay the increase in the voltage level of the direct current power for at least one time period based on the output signal of the comparator, and wherein each delay circuit of the plurality of delay circuits are coupled to each other in parallel.

16. The circuit apparatus according to claim 15, wherein the delay unit comprises a comparator which senses the voltage level of the direct current power and compares the voltage level of the direct current power with a reference voltage, and gradually delays the increase in the voltage level of the direct current power for at least one time period based on an output signal of the comparator.

17. The circuit apparatus according to claim 15, wherein each delay circuit of the plurality of delay circuits comprises a feedback resistor having a first end which is coupled to a terminal in relation to the direct current power.

18. The circuit apparatus according to claim 17, wherein the terminal in relation to the direct current power comprises a terminal in which voltages of the direct current power are divided by a plurality of resistors.

19. The circuit apparatus according to claim 15, wherein each delay circuit of the plurality of delay circuits comprises a capacitor which starts being charged on the basis of the output signal of the comparator and delays the increase in the voltage level of the direct current power for a respective period of time.

20. The circuit apparatus according to claim 19, wherein each delay circuit of the plurality of delay circuits comprises a transistor which is switched on and off to couple a respective feedback resistor with a base voltage level GND based on a charging level of the respective capacitor.

* * * * *